United States Patent [19]

Hallez

[11] Patent Number: 4,887,676

[45] Date of Patent: Dec. 19, 1989

[54] DEVICE FOR CLOSING A CORE BARREL INSTALLED IN A DRILLING RIG

[75] Inventor: Charles P. Hallez, Tellin, Belgium

[73] Assignee: Diamant Boart Societe Anonyme, Brussels, Belgium

[21] Appl. No.: 181,347

[22] Filed: Apr. 14, 1988

[30] Foreign Application Priority Data

Apr. 14, 1987 [BE] Belgium ..... 8700395

[51] Int. Cl.[4] ..... E21B 25/10

[52] U.S. Cl. ..... 175/250; 175/251; 166/328; 166/329

[58] Field of Search ..... 175/250, 249, 244, 251, 175/58; 166/325, 328, 329, 332

[56] References Cited

U.S. PATENT DOCUMENTS

| | | | |
|---|---|---|---|
| 3,332,497 | 7/1967 | Page, Jr. | 166/329 |
| 3,850,194 | 11/1974 | Brown | 166/224 |
| 4,300,643 | 11/1981 | Lambot | 175/244 |
| 4,453,599 | 6/1984 | Fredd | 166/332 |
| 4,519,457 | 5/1985 | Holland et al. | 166/332 |

FOREIGN PATENT DOCUMENTS

| | | | |
|---|---|---|---|
| 2048996 | 12/1980 | United Kingdom | 175/250 |

*Primary Examiner*—Jerome W. Massie
*Assistant Examiner*—Terry Lee Melius
*Attorney, Agent, or Firm*—Sughrue, Mion, Zinn, Macpeak & Seas

[57] ABSTRACT

The invention relates to a device for closing, without a surge, one end of a core barrel installed in a mining or oil drilling rig, optionally equipped with a turbine.

This device comprises a tubular element in whose bore there is guided a sliding member which provides a passage for the drilling liquid under pressure, this sliding member being movable in the above-mentioned bore under the influence of a variation in the flow of drilling liquid between a first position in which it keeps a closing member such as a ball remote from a seat provided at the above-mentioned end of the core barrel and, when it has engaged in the second section of the bore allows the closing element to be held in the first section of the bore, and a second position in which it allows the closing element to pass from the first section of the bore into the second section thereof and to place itself on the seat of the core barrel when the sliding member returns to its starting position.

10 Claims, 2 Drawing Sheets

DEVICE FOR CLOSING A CORE BARREL INSTALLED IN A DRILLING RIG

BACKGROUND OF THE INVENTION

1. Field of the Invention

The present invention relates to a device for closing one end of a core barrel installed in equipment used for drilling for minerals or oil.

2. Description of the Prior Art

It is known that a core barrel can be installed at the end of a line of rotating hollow drill-rods used for test drilling, in particular in geological layers containing minerals and oil, said core barrel allowing samples to be taken from these layers, for example for analysis.

This core barrel which may be, for example, of the type described in Belgian Pat. No. 875016 comprises, on the one hand, an external rotating tube which is constituted by drill-rods and of which the lower end bears a welding ring and, on the other hand, an internal, non-rotating tube, the lower end of which is provided with an extracting cone.

In a core barrel of this type, a drilling liquid is injected inside the drill-rods from the surface.

At the beginning of the drilling operation, it is essential to guide the drilling liquid through the core barrel in order to clear and clean the debris which has accumulated at the bottom of the shaft during the rise and fall of the drill-rods.

A core sample which is representative of the ground cannot in fact be taken until the clearing operation is completed.

While cutting out a core sample, the flow of drilling liquid is generally diverted toward the exterior of the core barrel into an annular space surrounding it. This annular space is defined by the internal wall of the lower rod of the set of hollow drill-rods and the external surface of the internal tube of the core barrel.

In known boring or drilling equipment, the flow of drilling liquid is diverted by freely throwing, from the end of the line of drill-rods remote from the core barrel, a ball intended to close a seat provided at the upper end of the core barrel. It is known that the flow of drilling liquid can be increased in order to accelerate the descent of the ball.

In practice, even though the flow of drilling liquid can be as high as 1,500 liters per minute, the descent of the ball in line of hollow drill-rods having a length of approximately 3,000 meters can take about 20 minutes, with a device according to British Pat. No. 2,048,996 which corresponds to U.S. Pat. No. 4,452,322.

In addition, it has been found that, at the end of its drop, the ball abruptly strikes the above-mentioned seat and causes in the descending column of drilling liquid a surge which damages the core barrel and possibly the boring shaft.

This British patent proposes to divert the flow of drill flushing fluid by means of a valve body releasing a ball in the vicinity of the core barrel and closing a seat provided at the upper end of the core barrel.

The valve body is restrained in a releasable storage cavity arranged in the core drill device, in the vicinity of the core barrel by means of a latch consisting of an annular body formed as a piston housing under a preload. The core barrel is connected to the steam path of the drill flushing fluid by an inlet comprising a seat at the upper end of the core barrel. The piston is movable downwards against the preload when the pressure of the drill flushing fluid is increased to a maximal value by the operators of the drilling equipment at the surface.

The piston, provided with a lateral opening, liberates the ball which reaches and closes immediately, but violently, the seat at the inlet of the core sleeve, stops the flow of drill flushing fluid through the core sleeve, and diverts the flow into the annular space between the outer sleeve and the core sleeve.

This boring or drilling apparatus thus has the drawback that the ball, at the end of its drop, under excessive flow velocities abruptly strikes the above-mentioned seat and causes a surge which damages the core barrel and possibly the boring shaft.

BRIEF SUMMARY OF THE INVENTION

The present invention aims to overcome these disadvantages and relates to a device for rapidly closing the seat provided at the upstream end of the core barrel, without causing a surge in the column of drilling liquid.

The device according to the invention for closing the upstream end of a core barrel, is essentially characterised in that it comprises a tube element similar to those forming the line of drill-rods and in whose bore there is guided a sliding member providing a passage for drilling liquid under pressure, this sliding member being caused to make a first movement under the influence of an increase in the flow of drilling liquid between an initial rest position and a remote stable position in which it holds a closing element remote from a seat provided at the end of the core barrel and being brought back, under the influence of a subsequent reduction in the flow, to its starting position in which it allows this closing element to place itself on the above mentioned seat.

It is preferable, according to a feature of the invention, that this closing element be formed by a solid metal ball separate from the sliding member.

According to a further feature of the invention, the sliding member is provided at one end with an attachment directed towards the above-mentioned end of the core barrel, this attachment being provided with a protuberance having a shape which is such that, in the initial rest position of the sliding member, the attachment holds the ball in a first section of the bore of the tubular element, while, in the remote stable position, the protuberance holds the ball in a second section of the bore of the tubular element and allows the ball to be released towards the seat of the core barrel when the sliding member re-occupies its starting position.

In an embodiment of the device according to the invention, the above-mentioned attachment of the sliding member has a cylindrical free end which is coaxial with the bore of the tubular element. This bore is formed by successive coaxial cylindrical sections, a first one of these sections having a diameter substantially equal to that of the attachment increased by twice the diameter of the ball, the second of these sections having a diameter greater than that of the free end of the protuberance increased by at least twice the diameter of the ball, whereas a third section of the bore, adjacent to the second section thereof and located on the side of the above-mentioned end of the core barrel, has a diameter smaller than the diameter of the above-mentioned free end of the attachment increased by twice the diameter of the ball, in such a way that the sliding member occupies a stable upper initial rest position in which the cylindrical end of the attachment, when engaged in the second section of the bore, allows the ball to be held in the first section of this bore and that the sliding member occupies a stable lower position in which it allows the ball to pass from the first section of the bore into the second section thereof and to place itself on the seat of the core barrel when the sliding member returns to its starting position.

The sliding member provided in the device according to the present invention is preferably formed by a sleeve comprising, on the one hand, an orifice for throttling the flow of drilling liquid in the vicinity of its end remote from the end bearing the attachment and, on the other hand, a series of divergent holes for the delivery of the hydraulic liquid, situated in the vicinity of its end bearing the attachment.

A spring permanently causes the sliding member to travel in the direction opposed to the direction of the drilling liquid.

According to a further feature of the invention, the free end of the attachment holds the ball in a first section of the above-mentioned bore which is situated upstream of the second section thereof, at least until the moment when the free end of the attachment engages in the third section of the bore.

Further features and details of the invention will appear from the following detailed description in which reference is made to the accompanying drawings which show, by way of a non-limiting example, an embodiment of a device according to the invention.

BRIEF DESCRIPTION OF THE DRAWINGS

In these various Figures, the same reference numerals designate identical elements.

DETAILED DESCRIPTION

Figure 1:
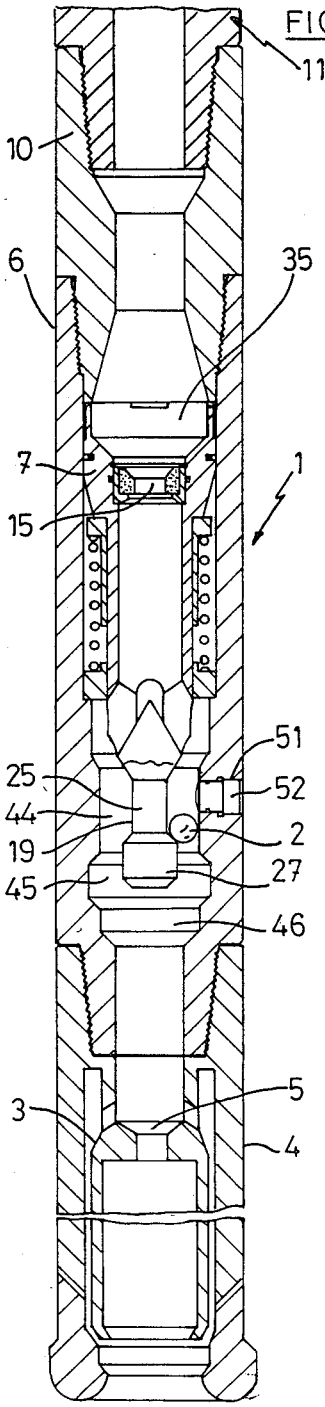
FIG. 1 shows a cross section through a device according to the invention in which a sliding member occupies an initial rest position in which it holds a ball.

FIG. 1 is a cross sectional view of a device according to the invention designated in its entirety by the reference numeral 1 in which a ball 2 which is intended to close the upstream end 3 of a core barrel 4 by applying itself to the seat 5 provided for the ball 2 at said end 3.

The device 1 comprises a tubular element 6 in whose bore there is guided a sliding member 7 which provides a passage for a drilling liquid under pressure (direction of the arrow X). The tubular element 6 comprises, at its upstream end 8, tapping 9 in which there is screwed a hollow drill-rod 10 advantageously equipped a turbine 11 or with a hole base motor and, at its downstream end 12, a screw thread 13 on which the core barrel 4 is screwed. The turbine 11 which is rotated during the passage of the drilling liquid in the direction of the arrow X, sets the device 1 as well as the core barrel 4 into rotation.

The sliding member is constituted by a sleeve 14 comprising, on the one hand, a throttling orifice 15 for throttling the flow of drilling liquid in the vicinity of its upstream end 16 and, on the other hand, a series of divergent holes 17 for the delivery of the drilling liquid located in the vicinity of its downstream end 18 bearing an attachment 19. The sleeve 14 ends, upstream of the orifice 15 for throttling the flow of drilling liquid, with a funnel-shaped member 20, intended to guide the flow of liquid towards the throttling orifice 15. The sleeve 14 comprises an annular stop 21 on its external face 22 in the vicinity of its upstream end 16, this stop 21 holding a collar 23 of a bushing 24 in position.

The attachment 19 provided in the vicinity of the downstream end 18 of the sleeve 14 is formed by a cylindrical rod 25 bearing at its free end 26 adjacent to the core barrel 4, a head-shaped protuberance 27, said head-shaped protuberance 27 having the form of a cylinder 28 provided at each of its ends with a truncated cone shaped outlet 29, 30.

The sleeve 14 forming the sliding member comprises, in the vicinity of the funnel-shaped member 20, a cylindrical external surface 31 adjacent to the internal surface 32 of the tubular element 6, this surface 31 comprising an annular groove 33 in which there is placed a gasket 34.

The tubular element 6 comprises a passage 35 formed, from the upstream end to the downstream end, by a cylindrical section 36, which is in contact with the cylindrical external surface 31 having a diameter smaller than that of this section 36, so as to form an annular flange 38, on which there rests a collar 39 provided with a flange 40, a bore 41 and finally, at its downstream end, a last cylindrical section 42 having a diameter greater than the diameter of the ball 2.

The protuberance or head 27 of the sliding member 7 moves in the bore 41, this sliding member 7 moving under the influence of a loss of charge due to a variation in the flow of drilling liquid. When the flow of drilling liquid is great, the loss of charge due to the passage of the fluid through the throttle 15 of the sliding member 7 is great and the sliding member 7 moves in the direction of the flow (direction X) of the drilling liquid against the action of a coil spring 43 located between the collar 23 of the bushing 24 resting on the stop 21 of the sliding member 7 and the flange 40 of the collar 39 resting on the annular flange 38 of the tubular element 6.

The bore 41 is constituted by coaxial cylindrical sections 44, 45, 46, connected to one another and to the cylindrical sections 42 and 37, by truncated cone-shaped sections 47, 48, 49, 50.

Figure 3:
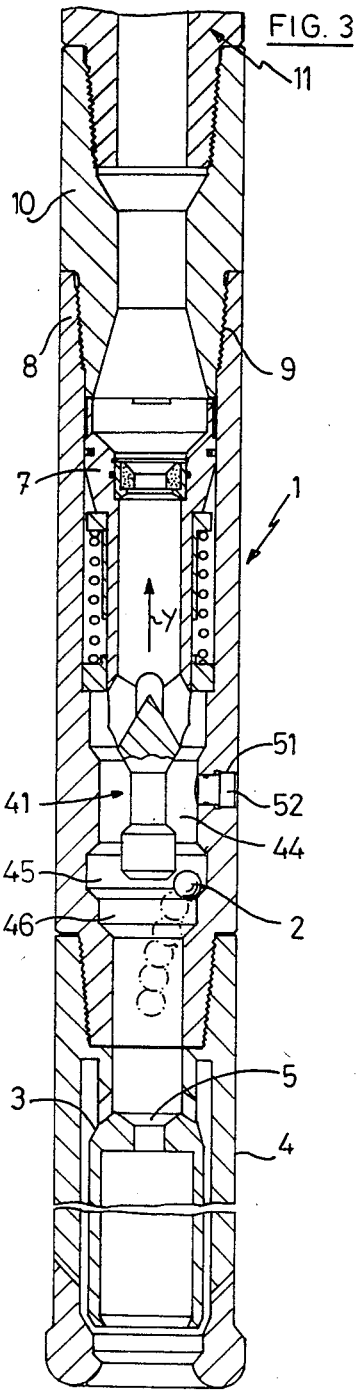
Figure 4:
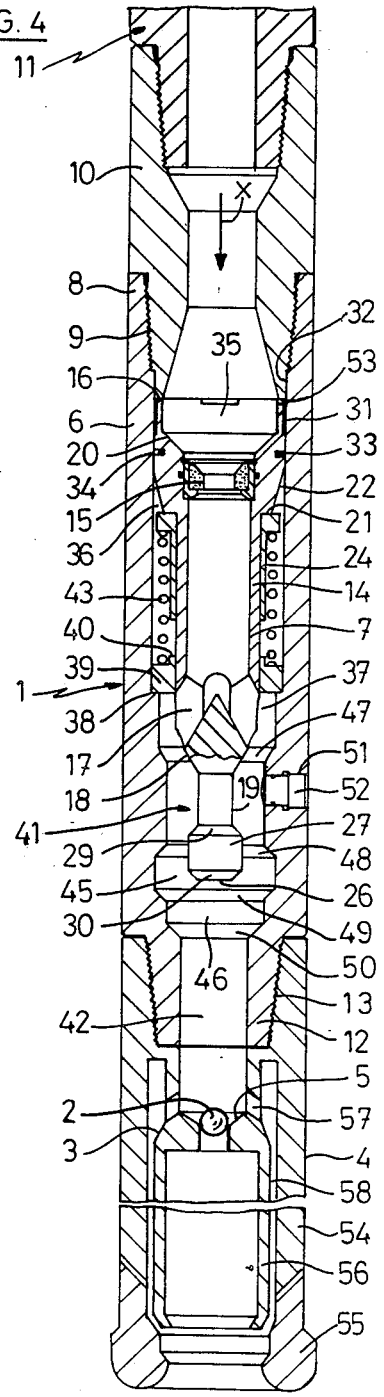
FIG. 4 is a cross sectional view similar to FIGS. 1 and 3, showing the device according to the invention in which the ball closes the upstream end of the core barrel.

The central cylindrical section 45 of the bore 41 has a diameter greater than that of the protuberance or head 27 of the attachment 19 increased by twice the diameter of the ball 2, whereas the cylindrical portion 46, of this bore 41 has a diameter smaller than the diameter of the protuberance or head 27 increased by twice the diameter of the ball 2, in such a way that the head 27, when engaged in the cylindrical section 46, allows the ball 2 to be held in the central cylindrical section 45 whereas, when it is extracted from this cylindrical section 46, it allows the ball 2 to pass from the central cylindrical section 45, into the cylindrical section 46 and to apply itself to the seat 5 of the core barrel 4 (see FIGS. 3 and 4).

Figure 2:
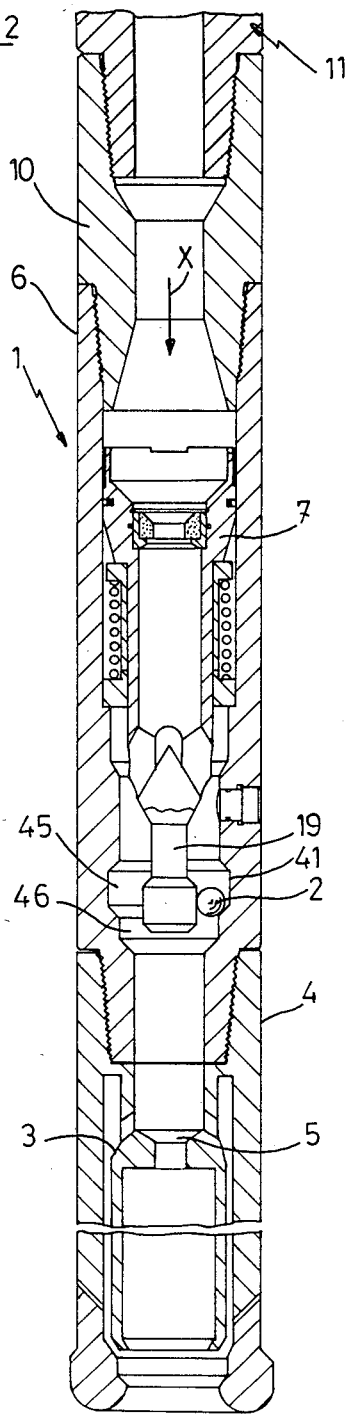
FIGS. 2 and 3 also show a cross section through the device according to the invention shown in FIG. 1, in which the sliding member and the ball occupy different positions.

The cylindrical section 44 located upstream of the central cylindrical section 45 of the bore 41 has a diameter smaller than the diameter of the protuberance or the head 27 increased by twice the diameter of the ball 2 but greater than the diameter of the rod 25 increased by twice the diameter of the ball 2, such that a ball 2 introduced into the upstream cylindrical section 44 through a hole 51 provided with a removable stopper 52, remains in this section 44 at least until the moment when the head 27 engages in the cylindrical section 46 of the bore 41 (see FIGS. 2 and 3). The downstream end 53 of the turbine 11 acts as a stop for the sliding member 7.

The core barrel 4 may be constituted by an external tube 54 equipped with a drilling ring 55 in which there is accommodated a hollow drill-rod 56 comprising the seat 5 for the ball 2 at its upstream section 55.

When the ball 2 closes the end 3 of the hollow rod 56, the flow of drilling liquid is guided in divergent orifices 57 toward the annular space 58 located between the external tube 54 and the hollow rod 56, and the core sampling operation can take place.

A sequential description of the core sampling process using the device described above is illustrated in FIGS. 1 to 4.

As shown in FIG. 1, a ball is introduced through the hole 51 into the upstream cylindrical section 44 of the bore 41 before the boring operation is commenced, that is to say before the line of drill-rods and the core barrel are introduced into the drilling shaft.

The descent of the line of drill-rods causes earth to fall into the drilling shaft.

Before taking a test bore sample, it is convenient to pass the drilling liquid (direction of the arrow X) through the core barrel in order to clear and remove the debris which has accumulated at the bottom of the boring shaft during the descent and the rise of the line of hollow drill-rods. In fact, a core sample which is representative of the geological layer to be analysed cannot be removed until the debris clearing operation has taken place.

For this clearing operation, the flow of drilling liquid is advantageously adjusted to 1,900 liters per minute. Rinsing is thus carried out effectively and the loss of charge created in the throttling orifice 15 and which attains about 1 bar is just too weak to repel the sliding member subjected to the opposing action of the coil spring 43.

During the rinsing operation, the force applied to the sliding member due to the loss of charge in the throttle is in equilibrium with the force of compression of the spring. The rinsing flow creates a loss of charge which does not cause any significant movement of the sliding member. Any interruption, for example accidental, in the rinsing of the core barrel does not cause significant movement of the sliding member either.

When the operator considers that the rinsing operation is completed, he increases the flow of drilling liquid to 2,900 liters per minute for a short period, creating a loss of charge of about 3 bars in the throttling orifice 15 of the sliding member 7.

This loss of charge causes the sliding member 7 to travel in the direction of the flow of drilling liquid (arrow X) against the action of the coil spring 43. Thus, the head 27 of the attachment 19 of the sliding member 7 travels in the direction (X) of the flow of liquid and, when it has engaged in the third section 46 of the bore 41, it allows the ball 2 which has been introduced beforehand into the first section 44 arranged upstream of the bore 41 through the orifice 51 equipped with the stopper 52 to pass from the first upstream section 44 into the second section 45 of the bore 41 (see FIGS. 2 and 3).

When the operation of clearing the bottom of the shaft is completed and when the ball 2 is located in the second section 45 of the bore 41, the flow of drilling liquid is reduced or optionally stopped so that, due to the action of the spring 43 on the sliding member 7 and due to the slight or zero loss of charge in the throttling orifice 15 of the sliding member 7, this sliding member travels in the direction of the arrow Y. Thus, the head 27 of the sliding member 7 is extracted from the third cylindrical section 46 so as to allow the ball 2 to pass from the second section 45 into the third section 46. The ball 2 can thus apply itself, by gravity, to the seat 5 of the core barrel 4 (see FIGS. 3 and 4).

This minimal or zero flow makes it possible to avoid a surge which might have caused an abrupt stoppage of the flow of liquid from the flow of drilling liquid inside the core barrel.

Such a surge is particularly harmful in a boring core barrel because a sudden deviation in the flow of drilling liquid is manifested by the simultaneous creation of a reduced pressure inside the core barrel and an excess pressure outside the core barrel.

The simultaneous reduction in pressure inside the core barrel and increase in pressure outside the core barrel could cause radial buckling and crushing of the core barrel which, as known, necessarily comprises thin walls.

Once the ball has been placed on the seat of the core barrel 4, as shown in FIG. 4, the core sampling operation can take place.

For this purpose, a flow of drilling liquid of about 1,100 liters per minute may be necessary to set the core barrel 4 as shaft as the device according to the invention 1 into rotation by means of the turbine 11. The drilling fluid is guided through the divergent orifices 57 towards the annular space 58 of the core barrel 4 so as not to damage the sampled core. Such a flow of 1,100 liters per minute creates a loss of charge of about 0.5 bar in the throttling orifice 15 of the sliding member 7.

It is obvious that core barrels other than the one shown and described in this specification can be used. Thus, a double core barrel of the type described in Belgian Pat. No. 875 016 can be used.

The device according to the invention, the core barrel, the turbine and the hollow drill-rods are advantageously composed of steel, whereas the drilling ring advantageously contains particles of abrasive materials such as diamond, corundum, tungsten or silicon carbide, optionally agglomerated in the form of thin slabs.

I claim:

1. A device for closing an upper end of a core barrel installed in equipment for drilling for minerals or oil, comprising a tube element in the line of pipes and in whose bore there is guided a sliding member means which provides a passage for drilling liquid under pressure, this sliding member means being caused to perform a first movement under the influence of an increase in the flow of drilling liquid between an initial rest position and a remote stable position in which it keeps a closing element remote from a seat provided at the upper end of the core barrel and being brought back under the influence of a subsequent reduction of flow to its initial position in which it allows this closing element to apply itself to the above-mentioned seat;

wherein the closing element is separate from the sliding member means;

wherein the closing element is a solid metal ball; and wherein the sliding member means is provided, at a lower end, with an attachment directed towards the upper end of the core barrel, this attachment being provided with a protuberance having a form such that, in the initial rest position of the sliding member means, the attachment holds the ball in a first section of the bore of the tubular element whereas, in the remote stable position, the protuberance holds the ball in a second section of the bore in the tubular element and allows the ball to be released towards the seat of the core barrel when the sliding member means re-occupies its initial position.

2. A device according to claim 1, in which the above-mentioned sliding member attachment has a free cylindrical end coaxial with the bore of the tubular element and in that this bore is formed by successive coaxial cylindrical sections, a first one of these sections, arranged upstream, having a diameter substantially equal to that of the attachment increased by twice the diameter of the ball, a second of these sections having a diameter greater than that of the free end of the protuberance increased by at least twice the diameter of the ball, whereas a third section of the bore adjacent to the second section thereof and located downstream of the side of the upper end of the core barrel has a diameter smaller than the diameter of the lower end of the attachment increased by twice the diameter of the ball.

3. A device according to claim 2, in which the sliding member means occupies an upper stable rest position in which the upper edge of a protuberance of the attachment engaged in the second section of the bore allows the ball to be held in the first section of the bore.

4. A device according to claim 2, in which the sliding member means is formed by a sleeve comprising, on the one hand, a throttling orifice for throttling the flow of drilling liquid in the vicinity of its end remote from the end bearing the attachment and, on the other hand, a series of divergent holes for the discharge of the hydraulic liquid located in the vicinity of its end bearing the attachment.

5. A device according to claim 4, in which the sliding member means occupies a stable lower position in which the protuberance of the attachment is engaged in the third section of this bore by downwards movement when the loss of charge created by the discharge of liquid in the throttling orifice is greater than the thrust of the spring.

6. A device according to claim 2, in which a spring permanently biases the sliding member means so that it moves in the opposite direction to the drilling liquid.

7. A device according to claim 6, in which the spring is a coil spring accommodated along a flange of a collar resting on an annular flange of the above-mentioned tubular element.

8. A device according to claim 1, in which the lower end of the attachment holds the ball in the first section of the above-mentioned bore located upstream of the second section thereof, at least until the lower end of the attachment engages in a third section of the bore.

9. A device according to claim 8, in which the tubular element has an orifice provided with a removable stopper allowing the ball to be introduced in the first section of the above-mentioned bore.

10. A device according to claim 1, in which the tubular element is provided with means for connecting it to the core barrel and means for connecting it to a rotating tube of the drilling equipment.

* * * * *